United States Patent [19]

Rear

[11] Patent Number: 4,534,422

[45] Date of Patent: Aug. 13, 1985

[54] FLUID OPERATED HAMMER

[76] Inventor: Ian G. Rear, 53 Louise St., Nedlands, Western Australia, Australia

[21] Appl. No.: 533,952

[22] Filed: Sep. 20, 1983

Related U.S. Application Data

[63] Continuation of Ser. No. 277,048, Jun. 24, 1981.

[51] Int. Cl.[3] ..... E21B 4/14

[52] U.S. Cl. ..... 173/134; 173/135; 173/138; 173/13; 173/17; 91/24; 91/234

[58] Field of Search ..... 173/17, 134, 135, 137, 173/138, 139, 13; 91/24, 25, 26, 234

[56] References Cited

U.S. PATENT DOCUMENTS 3,826,316 7/1974 Bassinger ..... 173/17
4,312,412 1/1982 Pillow ..... 173/17

FOREIGN PATENT DOCUMENTS 1552975 9/1979 United Kingdom ..... 173/19

*Primary Examiner*—E. R. Kazenske
*Assistant Examiner*—W. Fridie
*Attorney, Agent, or Firm*—Harness, Dickey & Pierce

[57] ABSTRACT

In deep bore drilling it is usual to use a fluid operated percussive hammer to provide necessary drive for the boring operation. However a difficulty which is encountered with hammers which are currently in use is that the manufacture of the components for such hammers involves considerable amount of precise machining which not only increases the manufacturing cost of such units but also reduces the service life of the components. Some of the typical hammers in use generally comprise an outer cylindrical casing with a feed tube positioned concentrically within the casing and a piston slidably mounted within the casing and over the feed tube to reciprocate therein and impact on a drill bit mounted in and retained at the bottom of the casing. In order to effect the reciprocating action of the piston fluid passage ways are provided in the feed tube and/or the casing which periodically communicate with ports provided in the piston to periodically admit fluid to the chambers above and below the piston to either lift it away from the drill bit or drive it so as to impact onto the drill bit.

20 Claims, 11 Drawing Figures

13
15
14
23
26
25b
25a
28
24
27
11
12
16
29
30
31
20
18
17

13
14
29
26
30
24
31
20
11
12

13
25b
26
25a
28
27
11
12
20

FLUID OPERATED HAMMER

This is a continuation of application Ser. No. 277,048, filed June 24, 1981.

This invention relates to an improved fluid operated hammer.

In deep bore drilling it is usual to use a fluid operated percussive hammer to provide necessary drive for the boring operation. However a difficulty which is encountered with hammers which are currently in use is that the manufacture of the components for such hammers involves considerable amount of precise machining which not only increases the manufacturing cost of such units but also reduces the service life of the components. Some of the typical hammers in use generally comprise an outer cylindrical casing with a feed tube positioned concentrically within the casing and a piston slidably mounted within the casing and over the feed tube to reciprocate therein and impact on a drill bit mounted in and retained at the bottom of the casing. In order to effect the reciprocating action of the piston fluid passage ways are provided in the feed tube and/or the casing which periodically communicate with ports provided in the piston to periodically admit fluid to the chambers above and below the piston to either lift it away from the drill bit or drive it so as to impact onto the drill bit.

In such hammers, it has been known for such hammers to prematurely fail due to excessive wear of the casing and/or feed tube and/or piston. One major cause of such excessive wear has been the misalignment of the feed tube withihn the bore of the casing. It is current practice in at least one form of hammer to mount the feed tube of the hammer into the top sub of the hammer which is then threadably mounted into the casing. Alternatively it is practice to locate the feed tube in a counterbored portion at one end of the casing. In such circumstances, to ensure that the feed tube is aligned concentrically within the bore of the casing on assembly of the hammer, involves precise machining of the feed tube, casing, counter-bore, casing thread, top sub and top sub thread and very stringent quality control.

It is an object of this invention to reduce the degree of precise machinery of components of fluid operated hammers.

In one form the invention resides in a fluid operated hammer comprising a cylindrical casing having a bore for slidably receiving a piston, a top sub mounted at one end, a drill bit mounted to the other end by means of a chuck, a feed tube concentrically mounted within the upper end of the bore of the casing and extending downwardly into the casing, said feed tube being connectable to a fluid source through said top sub, a piston slidably mounted within the bore of said casing over said feed tube, to reciprocate within the casing and periodically impact on the drill bit.

According to a preferred feature of the invention the feed tube is mounted to and located in the upper end of the bore of the casing and is isolated from the top sub.

According to a further preferred feature of the invention the feed tube is mounted to the casing via an annular centalising ring concentrically located within the bore of said casing and wherein said ring is capable of being replaced by a ring of differing dimensions so as to vary the volume of the chamber formed between the piston and the centralising ring.

According to a preferred feature of the invention the internal walls of said casing are substantially uncontoured and the external walls of said feed tube are substantially uncontoured.

It is a preferred object of this invention to provide a fluid operated hammer which can be operated with fluids of varying pressures and/or can have variable characteristics of performance by the exchange of substantially minor internal components.

According to a further preferred feature of the invention the feed tube can be replaced with another of differing characteristics to vary the periodicity of communication of the fluid to the ends of the piston.

According to a further preferred feature of the invention there are two sets of apertures provided in the feed tube spaced longitudinally from each other, one set communicating with the port provided in one end of the piston adjacent the one end of said casing when said one end is adjacent the top sub and the other set of apertures communicating with the port in the other end of the piston adjacent the other end of said casing when said other end is in contact with the drill bit.

A further preferred feature of the last mentioned preferred feature resides in said one set of apertures comprising at least two longitudinally spaced apertures which communicate with said one end of said piston during its movement towards said drill bit to provide a sequential thrust towards the drill bit.

According to a preferred feature of the last two mentioned features, said other set of apertures have a total dimension around the circumference of the feed tube greater than their axial dimension.

According to a further preferred feature of the invention said drill bit has an enlarged innermost end and is capable of limited axial movement in the chuck and bears on a bit retaining ring located in the chuck when the drill bit is in its outermost position in the chuck wherein a resilient annular member is mounted in the chuck to absorb some of the shocks exerted on the bit ring by the enlargement.

In providing the passage ways in the casing and ports in the piston of prior art fluid operated hammers, and to facilitate periodic communication between either end of the piston, it has been deemed necessary to contour the external surface of the feed tube and the internal surface of the casing. It is also being found necessary to machine the external and/or internal faces of the piston in order to facilitate the communication between the passage ways and ports. The provision of such passage ways in the casing and feed tube and ports and complicated machining in the piston has not only increased the manufacturing cost of hammer components and assemblies but has also decreased the service life of hammers. Where a casing is provided with passage ways drilled holes or undercuts in its wall the degree of wear which can be tolerated on the wall before leakage occurs from the passage ways to the exterior of the hammer is reduced. In addition, by contouring the external face of the feed tube the cost of the feed tube is not only increased but the number of edges which can be abrasively engaged by the piston are also increased as the piston cycles up and down in the casing.

It is an object of this invention to provide a fluid operated hammer which does not require any ports or passage ways in the casing of the hammer or machining of the internal face of the casing and the external face of the feed tube.

In another form the invention resides in a fluid operated hammer comprising a cylindrical casing having a bore for slidably receiving a piston, a top sub mounted at one end, a drill bit mounted to the other end by means of a chuck, a feed tube concentrically mounted within the upper end of the bore of the casing and extending downwardly into the casing, said feed tube being connectable to a fluid source through said top sub, a piston slidably mounted within the bore of said casing over said feed tube, the internal walls of said casing are substantially uncontoured and the external walls of the feed tube being substantially uncontoured, at least one aperture provided in the walls of said feed tube, at least one port provided at each end of the piston, each port opening at spaced locations into the bore of the piston to periodically communicate with said aperture as a result of slidable movement of the piston over the feed tube to alternately drive the piston towards the drill bit to impact thereon and to drive the piston away from the drill bit towards the one end of the casing.

According to a preferred feature of the invention the feed tube is mounted to and located in the upper end of the bore of the casing and is isolated from said top sub.

According to a further preferred feature of the invention there are two sets of apertures provided in the feed tube spaced longitudinally from each other, one set communicating with the port provided in one end of the piston adjacent the one end of said casing when said one end is adjacent the top sub and the other set of apertures communicating with the port in the other end of the piston adjacent the other end of said casing when said other end is in contact with the drill bit.

According to a further preferred feature of the last mentioned preferred feature, said one set of apertures comprises at least two longitudinally spaced apertures which communicate with said one end of said piston during its movement towards said drill bit to provide a sequential thrust towards the drill bit.

According to a further preferred feature of the last two mentioned features, said other set of apertures have a combined dimension around the circumference of the feed tube greater than their axial dimension.

According to a further preferred feature of the invention, said drill bit has an enlarged innermost end and is capable of limited axial movement in the chuck and which bears on a bit retaining ring located in the chuck when the drill bit is in its outermost axial position in the chuck wherein a resilient annular member is mounted in the chuck to absorb some of the shock forces exerted on the bit retaining ring by the enlargement.

Fluid operated hammers currently in use are capable of operating at a variety of pressures only after a number of components of fairly complex design are exchanged for similar components of differing dimensions and mass to vary the length of movement and/or periodicity of movement of the piston.

It is a preferred object of this invention to provide a fluid operated hammer which can be operated with fluids of varying pressures and/or can have variable characteristics of performance by the exchange of substantially minor internal components.

According to a further preferred feature of the invention the feed tube can be replaced with another of differing characteristics to vary the periodicity of communication of the fluid to the ends of the piston.

According to a further preferred feature of the invention the feed tube is mounted to the casing via an annular centralising ring concentrically located within the bore of said casing and wherein said ring is capable of being replaced by a ring of differing dimensions so as to vary the volume of the chamber formed between the piston and the centralising ring.

In addition with fluid operated hammers in use when the hammer is placed in the "blow-down" position in which the hammer is inoperative and the anvil of the drill bit is in contact with the bit retaining ring there can often be failure of the bit retaining ring or the portion of the drill bot engaged by the bit retaining ring. This is due to the anvil being impacted by the piston of the hammer when the drill bit first moves to the "blow-down" position or due to "back hammering" occuring, when the hammer is in the "blow-down" position. In some cases, it has been known for hammers to fail regularly when such hammers are involved in normal operational use. Such failure not only causes considerable delay in drilling operations but is expensive and requires an operator to maintain a large supply of spare parts for such hammers and can in some instances results in the abandonment of the drill hole when the failed components cannot be retrieved or withdrawn from said drill hole.

It is an object of this invention to absorb some of the shock forces exerted on the bit retaining ring when the hammer is in the "blow-down" position caused by the drill bit being impacted by the piston to reduce the possibility of failure of the drill bit or bit retaining ring in the course of normal operations.

In another form the invention resides in a fluid operated hammer comprising a cylindrical casing having a bore for slidably receiving a piston, a top sub mounted at one end, a drill bit mounted to the other end by means of a chuck, a feed tube concentrically mounted within the upper end of the bore of the casing and extending downwardly into the casing, said feed tube being connectable to a fluid source through said top sub, a piston slidably mounted within the bore of said casing over said feed tube, to reciprocate within the casing periodically impact on the drill bit, said drill bit being capable of limited slidable axial movement in the chuck and has an enlarged innermost end which bears on a bit ring located in the chuck when the drill bit is in its axially outermost position in the chuck, wherein a resilient annular member is mounted in the chuck to absorb some of the shock forces exerted on the bit ring by the enlargement.

According to a preferred feature of the invention the feed tube is mounted to and located in the upper end of the bore of the casing and is isolated from said top sub.

According to a preferred feaure of the invention the internal walls of said casing are substantially uncontoured and the external walls of said feed tube are substantially uncontoured.

According to a further preferred feature of the invention there are two sets of apertures provided in the feed tube spaced longitudinally from each other, one set communicating with the port provided in one end of the piston adjacent the one end of said casing when said one end is adjacent the top sub and the other set of apertures communicating with the portion the other end of the piston adjacent the other end of said casing when said other end is in contact with the drill bit.

According to a further preferred feature of the last mentioned preferred feature said one set of apertures comprises at least two longitudinally spaced apertures which communicate with said one end of said piston during its movement towards said drill bit to provide a sequential thrust towards the drill bit.

According to a preferred feature of the last two mentioned features, said other set of apertures have a combined dimension around the circumference of the feed tube greater than their axial dimension.

Fluid operated hammers currently in use are capable of operating at a variety of pressures only after a number of components of fairly complex design are exchanged for similar components of differing dimensions and mass to vary the length of movement and/or periodicity of the movement of the piston.

It is a preferred object of this invention to provide a fluid operated hammer which can be operated with fluids of varying pressures and/or can have variable characteristics of performance by the exchange of substantially minor internal components.

According to a further preferred feature of the invention the feed tube can be replaced with another of differing characteristics to vary the periodicity of communication of the fluid to the ends of the piston.

According to a further preferred feature of the invention the feed tube is mounted in the casing via an annular centralising ring concentrically located within the bore of said casing and wherein said ring is capable of being replaced by a ring of differing dimensions so as to vary the volume of the chamber formed between the piston and the centralising ring.

In most fluid operated hammers currently in use, the piston is effected by the introduction of pressurised fluid to the space between the piston and the top sub or other assembly parts located below the top sub. However this introduction of pressurised fluid is usually for a fixed interval of time which is only a portion of the time taken for the piston to complete its downward movement. Therefore the degree of thrust that can be applied to the piston is limited to effect its impact on the drill bit.

In cases where holes are to be bored upwards, as occurs in underground mines the effect of gravity can result in deterioration of the performance of the hammer.

It is an object of this invention to increase the period of time normally available in fluid operated hammers in which a thrust may be applied to the piston to effect its impact on the drill bit.

In another form the invention resides in a fluid operated hammer comprising a cylindrical casing having a bore for slidably supporting a piston a top sub mounted at one end, a drill bit mounted to the other end by means of a chuck, a feed tube concentrically mounted within the upper end of the bore of the casing and extending downwardly into the casing, said feed tube being connectable to a fluid source through said top sub, a piston slidably mounted within the bore of said casing over said tube two sets of apertures provided in the feed tube spaced longitudinally from each other, one set communicating with one port provided in one end of the piston adjacent the one end of said casing when said one end is adjacent the top sub and the other set of apertures communicating with another port in the other end of the piston adjacent the other end of said casing when said other end is in contact with the drill bit to alternately drive the piston towards the drill bit to impact thereon and to drive the piston away from the drill bit towards the one end of the casing wherein said one set of apertures comprises at least two axially spaced apertures which communicate with said one end of said piston during its movement towards said drill bit to provide a sequentially applied thrust to the piston towards the drill bit.

According to a preferred feature of the invention said other set of apertures have a combined dimension around the circumference of the feed tube which is greater than their axial dimension.

According to a preferred feature of the invention the feed tube is mounted to and located in the upper end of the bore of the casing and is isolated from said top sub.

According to a preferred feature of the invention the internal walls of said casing are substantially uncontoured and the external walls of said feed tube are substantially uncontoured.

Fluid operated hammers currently in use are capable of operating at a variety of pressures only after a number of components of fairly complex design are exchanged for similar components of differing dimensions and mass to vary the length of movement and/or periodicity of the piston.

It is a preferred object of this invention to provide a fluid operated hammer which can be operated with fluids of varying pressures and/or can have variable characteristics of performance by the exchange of substantially minor internal components.

According to a further preferred feature of the invention the feed tube can be replaced with another of differing characteristics to vary the periodicity of communication of the fluid to the ends of the piston.

According to a further preferred feature of the invention the feed tube is mounted in the casing via an annular centralising ring concentrically located within the bore of the casing and wherein said ring is capable of being replaced by a ring of differing dimensions so as to vary the volume of the chamber formed between the piston and the centralising ring.

According to a further preferred feature of the invention said drill bit has an enlarged innermost end and is capable of limited axial movement in the chuck and bears on a bit retaining ring located in the chuck when the drill bit is in its outermost position in the chuck wherein a resilient annular member is mounted in the chuck to absorb some of the shocks exerted on the bit ring by the enlargement.

In addition, fluid operated hammers currently in use suffer from "back hammer" when the hammer is in the "blow-down" position. Such back hammer is the continued reciprocation of the piston in the hammer when the drill bit is in its outermost position in the chuck and if such back hammer persists, it can lead to failure of parts of the hammer assembly or drill bit. This problem can be caused by use of apertures in the feed tube which supply fluid to the drill bit end of the piston, being too large in the axial dimension in relation to the piston whereby only a small degree of movement is required by the piston for fluid to be directed from the "blow-down" flow path, to cause movement of the piston from the drill bit or even to effect both functions together. It has been a feature of some of the prior art hammers that the ports in the feed tube that pass fluid to the space between the piston and the drill bit to cause the piston to move away from the drill bit has an axial dimension equal or greater than their combined circumferential dimension around the feed tube.

In another form the invention resides in a fluid operated hammer comprising a cylindrical casing having a bore for slidably receiving a piston, a top sub mounted at one end, a drill bit mounted to the other end by means of a chuck, a feed tube concentrically mounted within the upper end of the bore of the casing and extending downwardly into the casing, said feed tube being connectable to a fluid source through said top sub, a piston slidably mounted within the bore of said casing over said feed tube two sets of apertures provided in the feed tube spaced longitudinally from each other, one set communicating with one port provided in one end of the piston adjacent the one end of said casing when said one end is adjacent the top sub and the other set of apertures communicating with another port in the other end of the piston adjacent the other end of said casing when said other end is in contact with the drill bit to alternately drive the piston towards the drill bit to impact thereon and to drive the piston away from the drill bit towards the one end of the casing wherein the other set of apertures have a total dimension around the circumference of the feed tube which is greater than their axial dimension.

According to a preferred feature of the invention, the other set of apertures comprise one aperture.

According to a preferred feature of the invention the other set of apertures comprise a plurality of apertures circumferentially spaced around the feed tube.

According to a preferred feature of the invention the feed tube is mounted to and located in the upper end of the bore of the casing and is isolated from said top sub.

According to a preferred feature of the invention the internal walls of said casing are substantially uncontoured and the external walls of said feed tube are substantially uncontoured.

According to a further preferred feature of the last mentioned preferred feature one set of apertures comprises at least two longitudinally spaced apertures which communicate with said one end of said piston during its movement towards said drill bit to provide a sequential thrust towards the drill bit.

Fluid operated hammers currently in use are capable of operating at a variety of pressures only after a large number of components of fairly complex design are exchanged for similar components of differing dimensions and mass to vary the length of movement and/or periodicity of movement of the piston.

it is a preferred object of this invention to provide a fluid operated hammer which can be operated with fluids of varying pressure and/or can have variable characteristics of performance by the exchange of substantially minor internal components.

According to a further preferred feature of the invention the feed tube can be replaced with another of differing characteristics to vary the periodicity of communication of the fluid to the ends of the piston.

According to a further preferred feature of the invention the feed tube is mounted to the casing via an annular centralising ring concentrically located within the bore of said casing and wherein said ring is capable of being replaced by a ring of differing dimensions so as to vary the volume of the chamber formed between the piston and the centralising ring.

According to a further preferred form of the invention the drill bit has an enlarged innermost end wherein said enlargement is capable of limited axial movement in the chuck and bears on a bit retaining ring located in the chuck when the drill bit is in its outermost axial position within the chuck wherein a resilient annular member is mounted in the chuck to absorb some of the shock forces exerted on said bit retaining ring by the enlargement.

The invention will be more fully understood in the light of the following description of several specific embodiments. The description is made with reference to the accompanying drawings of which:

Figures 1, 2, 3:
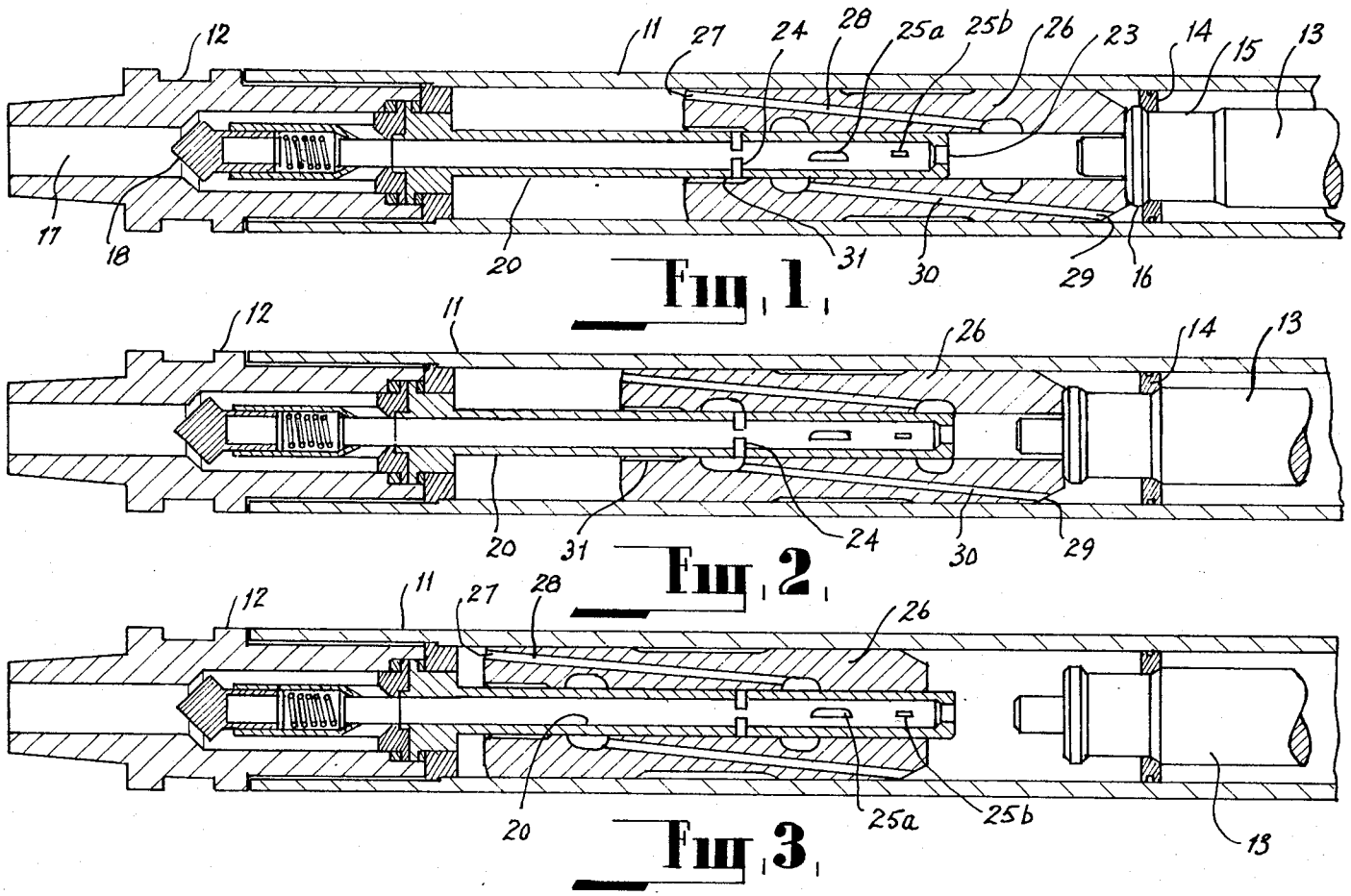
FIG. 1 is a sectional side elevation of a fluid operated hammer according to the first embodiment in the "blow-down" position.
FIG. 2 is a sectional side elevation of the fluid operated hammer of FIG. 1 in the "impact" position.
FIG. 3 is a sectional side elevation of the fluid operated hammer of FIGS. 1 and 2 with the hammer in the "raised" position.

The first embodiment of FIGS. 1, 2 and 3 is a fluid operated hammer which comprises a cylindrical casing 11 having a substantially uncontoured inner face with a top sub 12 mounted at one end and a drill bit 13 mounted at the other end. The drill bit is mounted within a drill chuck which is threadably engaged in the other end of the casing such that it is longitudinally slidable for a limited degree within the end of the chuck. Such limited slidable movement of the drill bit is facilitated by a bit ring 14 mounted in the inner end of the chuck and which is received within a waisted portion 15 at the innermost end of the drill bit. The innermost end of the drill bit 13 which extends beyond the bit ring 14 is formed with an enlarged portion which serves as the anvil 16 for the drill bit 13.

Figure 10:
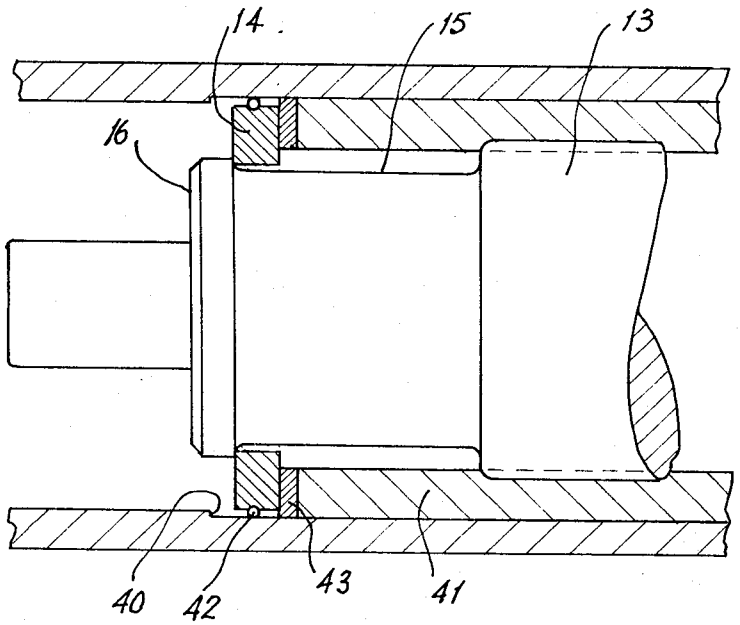
FIG. 10 is a part sectional elevation of a fluid operated hammer showing the mounting of the drill bit in the chuck.

As shown at FIG. 10, the bit retaining ring 14 is retained in the chuck between a shoulder 40 formed on the inner face of the chucks outer casing and a sleeve 41 received within the chuck. An O-ring seal 42 is located between the bit retaining ring and the outer casing of the chuck. The bit ring 14 is separated from the inner end of the sleeve 41 by a resilient ring 43. The resilient ring 43 is intended to absorb some of the shocks that may be imparted to the bit retaining ring when the anvil 16 of the drill bit is in contact therewith and is impacted by the piston of the hammer.

The top sub 12 is threadably engaged in the one end of the casing 11 and is provided with a fluid inlet port 17 which communicates with a spring loaded check valve 18 located within the top sub to prevent any reverse fluid flow and provided at the innermost end of the top sub 12.

Figure 11:
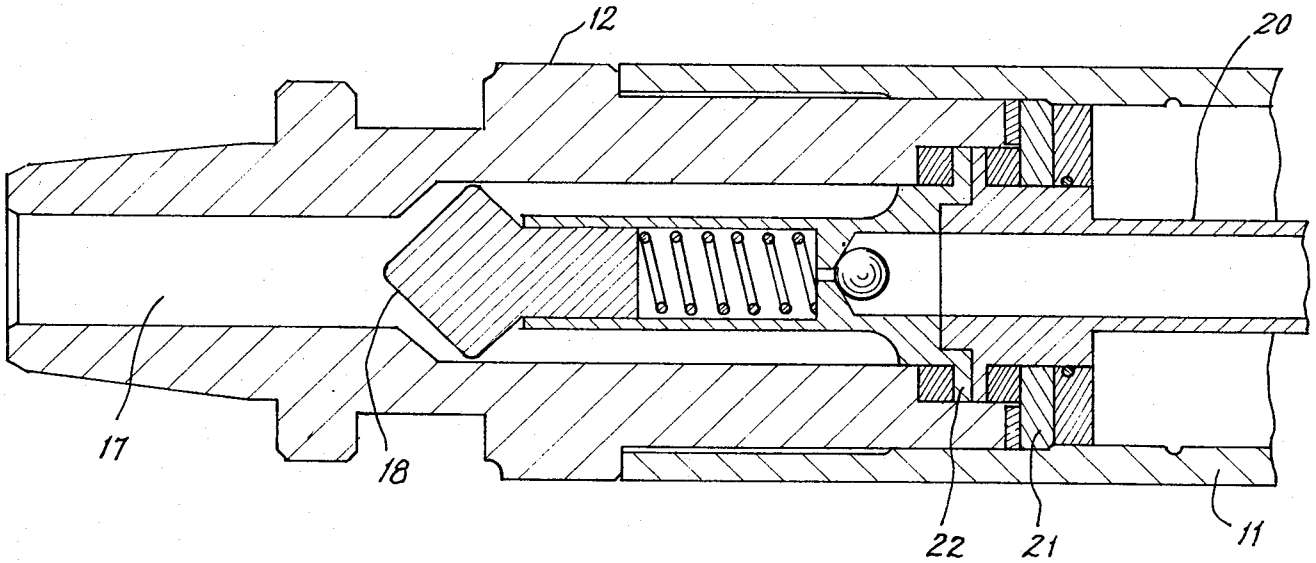
FIG. 11 is a part sectional elevation of a fluid operated hammer showing the mounting of the feed tube in the hammer.

The bore of the casing 11 supports a feed tube 20 which is concentrically mounted at the one end of the bore of the casing 11 in abutting relation with the inner end of the top sub 12. The feed tube 20 extends from the one end of the casing for a portion of the length of the casing. As shown at FIG. 11 the mounting of the feed tube comprises a centralising ring 21 which is accurately closely and concentrically retained in the one end of the bore of the casing 11. The centralising ring is also formed with a flange 21*a* which is loosely received in a counter-bored portion of the casing and which serves to limit axial movement of the ring 21 and feed tube 20. The centralising ring 21 receives the one end of the feed tube and accurately retains the feed tube such that it is concentrically located within the casing 11. A flange 22 at the one end of the feed tube overlies the outer axial face of the centralising ring 21 to be located within a suitably shaped recess formed within the top sub 12.

Suitable tolerances are provided between the top sub 12 and the flanged end of the feed tube 22 in order that any mis-alignment of the top sub will not effect the alignment of the feed tube 20 within the casing as established by the spacer ring 21. Suitable sealing resilient and accommodating means in the form of O-rings are provided in the centralising space between the centralising ring 21 and the flanged 22 of the feed tube and the top sub 12 and the flanged 22 of the feed tube to prevent any loss of fluid from the junctions therebetween and to allow some movement of the feed tube. The centralising ring 21 provides a means of supporting and centralising the feed tube concentrically within the bore of the casing 11 and thus the piston 26.

Previous means of locating the feed tube in a hammer having included threadably engaging the feed tube into the top sub and then threadably engaging the top sub onto the casing, or engaging the feed tube in a counter-bored portion of the casing which also threadably receives the top sub. As a result very careful quality control had to be maintained in the machining of the top sub, feed tube and casing in order for the feed tube to be located centrally within the bore of the casing on assembly of the hammer. If due to poor quality control the feed tube was not located centrally in the bore of the casing there can be accelerated wear of the feed tube, piston and casing which will result in premature failure of the hammer.

The centralising ring 21 may be readily exchanged with other rings of differing thickness in order that the volume of the space between the upper end of the piston 26 and the top sub may be varied. The free end of the feed tube is provided with a suitably dimensioned choke 23 which permits a controlled continuous flow of fluid down through the drill bit 13. The walls of the feed tube are uncontoured and are formed with two sets of apertures. One set 24 comprises a single aperture which extends for a considerable portion of the circumference of the feed tube but which has a relatively small dimension in the longitudinal axis of the feed tube. Alternatively the one set may comprise a series of circumferentially spaced apertures in the walls of the feed tube which have a relatively small axial dimension. The other set of apertures comprise a pair of longitudinally spaced apertures 25*a* and 25*b* located towards the free end of the feed tube from the one set of apertures 24. One aperture 25*a* of the other set of apertures which is located closest to said one set of apertures 24 is greater in size than the other of said apertures 25*b* and has a greater axial dimension than the other aperture 25*b*.

The hammer further supports within the casing 11 a piston 26 which is longitudinally slidable within said casing 11 and over said feed tube 20. Each end of said piston is provided with a port 27 and 29 which communicate with a passage way 28 or 30 respectively extending from the respective port to the internal bore of said piston. The passage ways 28 and 30 are formed by obliquely boring a hole from the respective end of said piston to the bore of said piston. In addition the end of the piston adjacent the top sub 12 is counterbored to provide an expanded portion 31 in the bore of the piston which extends for a small portion of the length of the bore.

As shown at FIG. 1 to place the hammer in the "blow-down" position the hammer is moved axially away from the base of the drill hole in order that the drill bit moves to its outermost position in the chuck and the bit ring 14 is engaged with the anvil 16 of the drill bit. When in the "blow-down" mode the piston 26 is retained in contact with the anvil 16. The maintenance of this position is a result of the counter-bored portion 31 at the one end of the hammer 26 being in communication with the one set of apertures 24 to provide fluid communication between the source of fluid pressure and the space located between the one end of the piston 26 and the top sub 12. Since no equivalent pressure or greater pressure is applied to the other end of the piston through the passage-way 30 the piston 26 is positively retained in contact with the anvil. Fluid from the top sub end of the piston escapes to the drill bit via port 27 and the one passage way 28.

Due to the small axial dimension of the one set of apertures if the piston should for some reason be moved from engagement with the anvil a considerable degree of movement of the piston is required for the one set of apertures to communicate with the drill bit end of the piston through the passage way 30 and port 29. The small axial dimension of the one set of apertures ensures that there can be no overlap between the counter-bored portion and the passage way 28 by the one set of apertures. Therefore, the possibility of back hammer is considerably reduced. In addition, due to the absence of restriction between the one set of apertures and the drill bit other than the counterbored portion 31 and the passage way 28 connecting the drill bit end of the piston with the bore of the piston the flow of air to the drill bit during "blow-down" is relatively unrestricted ensuring clearing of drill cuttings.

When the fluid operated hammer is moved axially towards the base of the drill hole such that the drill bit engages with the base of the bore hole the drill bit 13 moves into the fluid hammer. As a result (as shown in FIG. 2) the counter-bored portion 31 in the one end of the hammer 26 is isolated from the source of fluid pressure and the one passage way 28 connecting the top sub end port 27 of the piston 26 with the bore of the piston is isolated from the source of fluid pressure while the other passage way 30 connecting the drill bit port 29 of the piston 26 with the internal bore of the piston is in communication with the one set of apertures 24 in the feed tube 20, as a result fluid pressure from the fluid source is applied to the space between the drill bit end 29 of the piston 26 and the chuck 14. The resultant pressure differential produces a movement of the piston 26 from the drill bit.

The use of an aperture 24 of relatively small axial dimensions is a departure from previous practice and allows a greater control over the introduction of fluid at a precise point in the travel of the piston 26 and similarly causes the fluid flow to the piston to be shut off rapidly rather than having a gradual decrease as would occur if a longitudinally larger port were used.

If desired the one set of apertures 24 can be positioned to communicate fully with the drill bit end of the piston when the piston is raised a small distance from the anvil in order to make use of the reactive rebound of the piston after striking the anvil 16 in returning the piston to its position adjacent the centralising ring 21.

When the piston 26 is in its position adjacent the centralising ring 21 (as shown at FIG. 3) the other passage way 30 between the drill bit port 29 of the piston 26 and the bore of the piston is not in communication with any source of fluid pressure while the one passage way 28 providing communication between the top sub port 27 of the piston 26 and the bore is in communication with the one aperture 25*a* of the other set of apertures 25. The resultant increased pressure in the space between the top sub 12 and the corresponding end of the piston produces a thrust on the piston 26 to cause it to move towards the drill bit. The pressure producing the thrust on the piston 26 is reduced once the opening of the one passage way 28 into the bore of the piston 26 passes the one aperture 25*a* but is further reinforced when the opening of the one passage way 28 communicates with the other aperture 25*b* of the other set of apertures 25 during the movement of the piston 26 toward the drill bit.

The location of the spaced apertures 25*a* and 25*b* allows greater control over the distance that the piston 26 moves over previous methods which utilised one aperture only. The greater control stems from the fact that by variation of the spacing between the apertures 25*a* and 25*b* the frequency and force of impact of the piston 26 on the drill bit can be varied according to the geological conditions in which the hammer is being used or the pressure of the fluid being used. To effect such variation requires the replacement of the feed tube 20 only, whereas previous hammers have required the replacement of completely different assemblies to effect the same variation. In addition, by varying the spacer ring 21 simultaneously or independently with the feed tube the performance characteristics can be optimised to suit the conditions or specifications of the holes being drilled.

In existing hammers when the apertures required to effect the thrust on the piston to drive it onto the drill bit, are raised in position on the feed tube in order to lengthen the strike of the piston there is little increase in the impact force of the piston on the drill bit. By introducing a second aperture 25*b* additional pressure is introduced into the space above the piston to provide an additional thrust on the piston during its movement towards the drill bit. It will be appreciated that the use of the two apertures 25*a* and 25*b* also serves to introduce further fluid into the space above the piston during the movement of the piston from the drill bit. However since such fluid is introduced into a space previously evacuated of pressurised fluid in a precise and limited manner due to the reduced size of the second apertures 25*b* and since at the time of such introduction the piston has almost attained its maximum velocity such introduction does not greatly effect the pistons movement from the drill bit.

In addition the fluid input into the space between the top sub 12 and the piston 26 during the movement of the piston 26 from the drill bit serves to prevent the impact of the piston 26 with the centralising ring 21.

As a result of the embodiment a fluid operated hammer is produced which utilises a casing not having any passage ways formed in its wall and not having any contours formed on its internal surface to effect fluid communicating with the respective ends of the piston. In addition the hammer utilises a feed tube which is not contoured on its external surface and which only involve in its manufacture the location of the respective apertures. In addition, the feed tube 2 is accurately and centrally located within the casing 11 and is independent of any misalignment which may exist between the top sub 12 and the casing 11 due to inaccurate machining or tolerance variations in the machining of either component. Furthermore the piston 26 is provided with a minimum amount of machining which not only reduces the manufacturing cost of the piston 26 but also serves to maximise the mass of the piston. Similarly, because the external surface of the feed tube 20 is uncontoured, it can be of a reduced diameter from that currently in use and therefore the mass of the piston 26 can be further maximised.

In order that the operating characteristics of the hammer, such as stroke, the volumes of spaces within the hammer and the frequency of reciprocation of the piston 26 can be varied, the components of the hammer may be readily changed to provide substitute components of differing dimension, to effect such a change in performance as may be desirable when operating with compressors which provide fluids with greater or lesser pressures than a particular optimum pressure or in differing bore hole conditions.

Furthermore by use of an aperture having a large area but a small axial dimensions as the supply structure to return the piston to the position adjacent the centralising ring 21 the admission of fluid to effect the raising of the piston is controlled and the incidence of back hammer is considerably reduced. In addition, the use of a set of longitudinally spaced apertures to effect a thrust on the piston to produce movement towards the drill bit provides a greater downward impact-force by the piston on the anvil. Finally the incorporation of a resilient annular member between the bit retaining ring in the chuck and the anvil of the drill bit serves in absorbing at least some of the impact forces exerted on the anvil by the piston on the drill bit moving to the "blow-down" position or in the event of back hammer when in the "blow-down" position.

Figure 4:
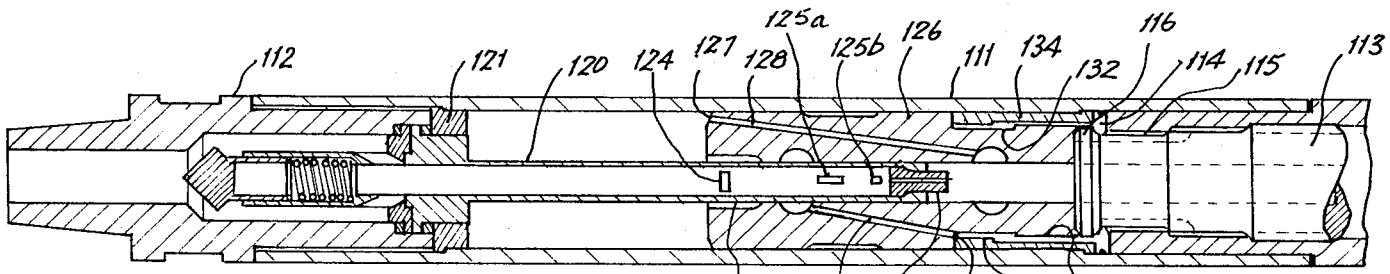
FIG. 4 is a sectional side elevation of a fluid operated hammer according to the second embodiment in the "blow-down" position.
Figure 5:
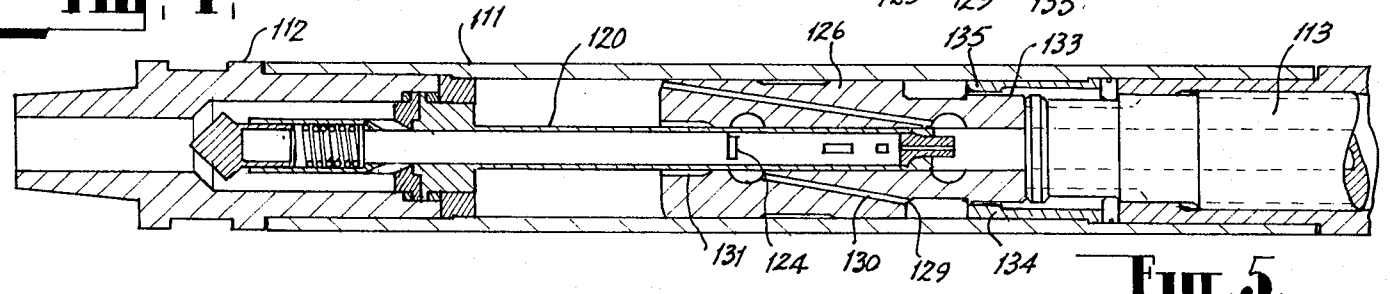
FIG. 5 is a sectional side elevation of the fluid operated hammer of FIG. 4 in the "impact" position.
Figure 6:
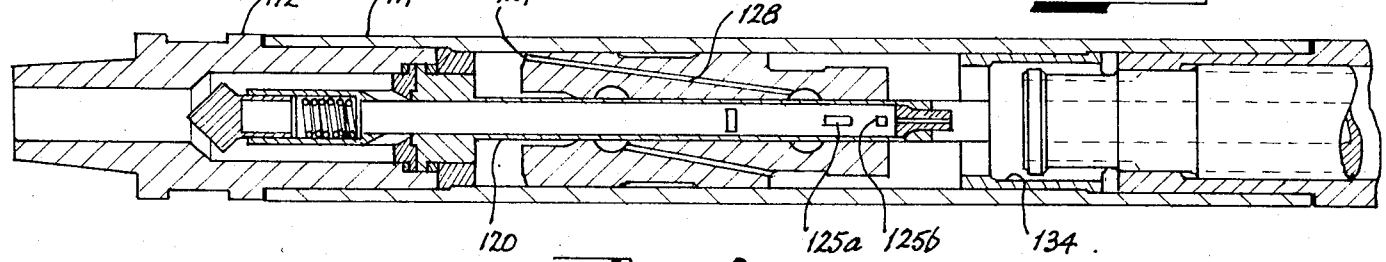
FIG. 6 is a sectional side elevation of the fluid operated hammer of FIGS. 4 and 5 with the hammer in the "raised" position.

The second embodiment of FIGS. 4, 5 and 6 is a fluid operated hammer which comprises a cylindrical casing 111 having a substantially uncontoured inner face with a top sub 112 mounted at one end and a drill bit 113 mounted at the other end in the same manner and having the same features as the hammer of the first embodiment including the resilient ring located in the chuck and associated with the bit retaining ring 114 which was described in the description of the first embodiment.

The casing 111 further supports a feed tube 10 which is concentrically mounted at the one end of the casing 111 in abutting relation with the inner end of the sub 112. The feed tube 20 extends from the one end of the casing for a portion of the length of the casing. The mounting of the feed tube is of the same form as that shown and described in the first embodiment.

As in the first embodiment the centralising ring 121 may be readily exchanged with other rings of differing thickness in order that the volume of the space between the upper end of the piston 126 and the top sub may be varied. The free end of the feed tube is provided with a suitably dimensioned choke 123 which permits a controlled continuous flow of fluid down through the drill bit 113. The walls of the feed tube are uncontoured and are formed with two sets of apertures. One set 124 comprises a single aperture which extends for a considerable portion of the circumference of the feed tube but which has a relatively small dimension in the longitudinal axis of the feed tube. Alternatively the one set may comprise a series of circumferentially spaced apertures in the walls of the feed tube which have a relatively small axial dimension. The other set of apertures comprise a pair of longitudinally spaced apertures 125*a* and 125*b* located towards the free end of the feed tube from the one set of apertures 124. One aperture 125*a* of the other set of apertures which is located closest to said one set of apertures 124 is greater in size than the other of said apertures 125*b* and has a greater axial dimension than the other aperture 125*b*.

The hammer further supports within the casing 111 a piston 26 which is longitudinally slidable within said casing 111 and over said feed tube 120. One end of said piston is provided with a port 127 while another port 129 is located at an intermediate position on the piston. Said ports communicate with a passage-way 128 and 130 respectively extending from the respective port to the internal bore of said piston. The passage-ways 128 and 130 are formed by obliquely boring a hole from the position of the respective port of said piston to the bore of said piston. In addition the end of the piston adjacent the top sub 112 is counterbored to provide an expanded portion 131 in the bore of the piston which extends for a small portion of the length of the bore.

The circumferential face of the piston 126 between the position of the other port 129 and the other end of the piston which is adjacent the drill bit is machined to reduced diameter and the outer end of that reduced diameter portion 132 is formed with a rib 133. In addition the drill bit end of the casing supports a sleeve 134 which extends a small distance beyond the innermost position of the anvil 116 of the drill bit 113. The inner most end of the sleeve 134 is formed with a rib 135 dimensioned such that the rib 133 at the other end of the piston 126 sealingly engages with the rib 135 on the sleeve when they are adjacent each other.

As shown at FIG. 4 to place the hammer in the "blow-down" position the hammer is moved axially away from the base of the drill hole in order that the drill bit moves to its outermost position in the chuck and the bit ring 114 is engaged with the anvil 116 of the drill bit. When in the "blow-down" mode the piston 126 is retained in contact with the anvil 116. The maintenance of this position is a result of the counter-bored portion 131 at the one end of the hammer 16 being in communication with the one set of apertures 124 to provide fluid communication between the source of fluid pressure and the space located between the one end of the piston 126 and the top sub 11. Since no equivalent pressure or greater pressure is applied to the other end of the piston through the passage-way 130 the piston 126 is positively retained in contact with the anvil. Fluid from the top sub end of the piston escapes to the drill bit via one port 127 and the one passage 128.

Due to the small axial dimension of the one set of apertures if the piston should for some reason be moved from engagement with the anvil a fair degree of movement of the piston is required for the one set of apertures to communicate with the drill bit end of the piston through the passage-way 130 and port 129. The small axial dimension of the one set of apertures ensures that there can be no overlap between the counter-bored portion and the passage way 128 by the one set of apertures. Therefore, the possibility of back hammer is considerably reduced. In addition, due to the absence of restriction between the one set of apertures and the drill bit other than the counter-bored portion 131 and the passage-way 128 connecting the drill bit end of the piston with the bore of the piston, the flow of air to the drill bit during "blow-down" is relatively unrestricted ensuring clearing of drill cuttings.

When the fluid operated hammer is moved axially towards the base of the drill hole such that the drill bit engages with the base of the bore hole the drill bit 113 moves into the fluid hammer. As a result (as shown in FIG. 5) the counter-bored portion 131 in the one end of the hammer 126 is isolated from the source of fluid pressure and the one passage way 128 connecting the top sub end port 127 of the piston 126 with the bore of the piston is isolated from the source of fluid pressure while the other passage way 30 connecting the drill bit port 129 of the piston 126 with the internal bore of the piston is in communication with the one set of apertures 124 in the feed tube 120. As a result fluid pressure from the fluid source is applied to the space between the reduced diameter portion 132 of the piston 126, the inner end of the sleeve 134 and the casing 111 due to the sealing engagement between the ribs 133 and 135 on the piston 126 and sleeve 134 respectively. The resultant pressure differential produces a movement of the piston 126 from the drill bit.

The use of an aperture 24 of relatively small axial dimensions is a departure from previous practice and allows a greater control over the introduction of fluid at a precise point in the travel of the piston 26 and similarly causes the fluid flow to the piston to be shut off rapidly rather than having a gradual decrease as would occur if a longitudinally larger port were used.

If desired the one set of apertures 24 can be positioned to communicate fully with the drill bit end of the piston when the piston is raised a small distance from the anvil in order to make use of the reactive rebound of the piston after striking the anvil 16 in returning the piston to its position adjacent the centralising ring 121.

The use of the sleeve 134 in the drill bit end of the casing reduces the volume of the space into which the other port 129 delivers fluid to effect movement of the piston from the drill bit. This reduces the volume of fluid required to return the piston to its position adjacent the centralising ring 121.

When the piston 126 is in its position adjacent the centralising ring 121 (as shown at FIG. 6) the other passage way 130 between the other port 129 of the piston 126 and the bore of the piston is not in communication with any source of fluid pressure while the one passage way 128 providing communication between the one port 127 of the piston 126 and the bore is in communication with the one aperture 125*a* of the other set of apertures 125. The resultant increased pressure in the space between the top sub 112 and the one end of the piston produces a thrust on the piston 126 towards the drill bit.

The pressure producing the thrust on the piston 126 is reduced once the opening of the one passage way 128 into the bore of the piston 126 passes the one aperture 125*a* but is further reinforced when the opening of the one passage way 128 communicates with the other aperture 125b of the other set of apertures 125 during the movement of the piston 126 toward the drill bit.

The location of the spaced apertures 125a and 125b allows greater control over the distance that the piston 126 moves over previous methods which utilise one aperture only. The greater control stems from the fact that by variation of the spacing between the apertures 125a and 125b the frequency and force of impact of the piston 26 on the drill bit can be varied according to the geological conditions in which the hammer is being used or the pressure of the fluid being used. To effect such variation requires the replacement of the feed tube 120 only, whereas previous hammers have required the replacement of completely different assemblies to effect the same variation. In addition, by varying the centralising ring 121 simultaneously or independently with the feed tube the performance characteristics can be optimised to suit the conditions or specifications of the holes being drilled.

In existing hammers when the apertures required to effect the thrust on the piston to drive it on the drill bit are raised in position on the feed tube in order to lengthen the strike of the piston there is little increase in the impact force of the piston on the drill bit. By introducing a second aperture 125b additional pressure is introduced into the space above the piston to provide an additional thrust on the piston during its movement towards the drill bit. It will be appreciated that the use of the two apertures 125a and 125b also serves to introduce further fluid into the space above the piston during the movement of the piston from the drill bit. However since such fluid is introduced into a space previously evacuated of pressurised fluid in a precise and limited manner due to the reduced size of the second apertures 125b and since at the time of such introduction the piston has almost attained its maximum velocity such introduction does not greatly effect the pistons movement from the drill bit.

In addition the fluid input into the space between the top sub 112 and the piston 126 during the movement of the piston 126 from the drill bit serves to prevent the impact of the piston 126 with the centralising ring 121.

As a result of the second embodiment a fluid operated hammer is produced having the same advantages as the first embodiment together with the advantage that a smaller volume of pressurised fluid is required to return the piston to the "raised" position.

Figures 7, 8, 9:
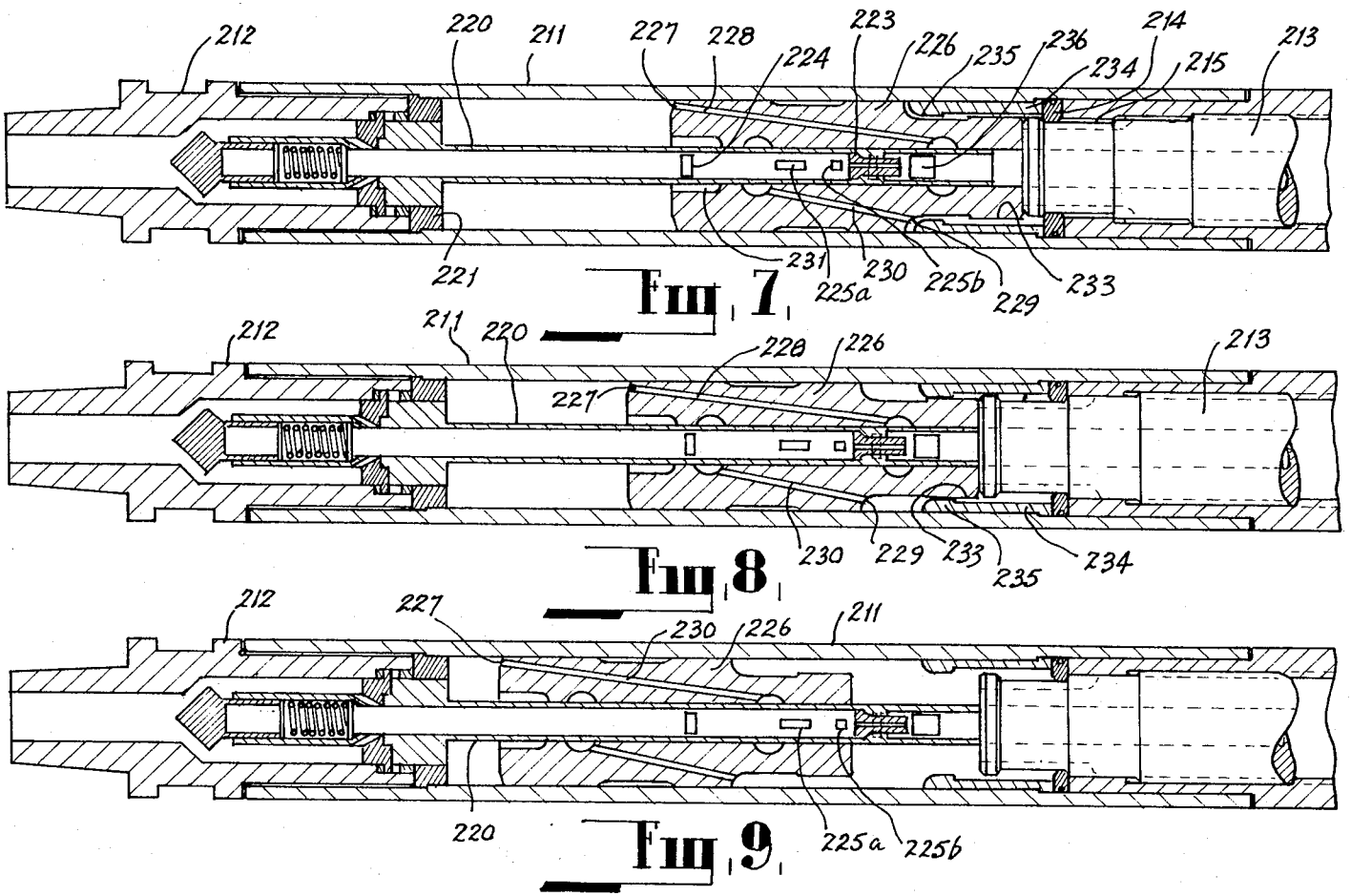
FIG. 7 is a sectional side elevation of a fluid operated hammer according to the third embodiment in the "blow-down" position.
FIG. 8 is a sectional side elevation of the fluid operated hammer of FIG. 7 in the "impact" position.
FIG. 9 is a sectional side elevation of the fluid operated hammer of FIGS. 7 and 8 with the hammer in the "raised" position.

The third embodiment of FIGS. 7, 8 and 9 is a fluid operated hammer which comprises a cylindrical casing 211 having a substantially uncontoured inner face with a top sub 212 mounted at one end and a drill bit 213 mounted at the other end in the same manner and having the same features as the hammer of the first embodiment including the resilient ring located in the chuck and associated with the bit retaining ring 214 which is described and shown in the description of the first embodiment.

The casing 211 further supports a feed tube 220 which is concentrically mounted at the one end of the casing 211 in abutting relation with the inner end of the top sub 212. The feed tube 220 extends from the one end of the casing for substantially the full length of the casing 211 such that its free end is received in the bore of the drill bit 213 when the drill bit 213 is in its innermost position in the casing but it is free of the drill bit when the drill bit is in its outer most position within the casing 211. The mounting of the feed tube to the top sub 212 is of the same form as that shown and described in relation to the first embodiment.

As in the first embodiment, the centralising ring 221 may be readily exchanged with other rings of differing thickness in order that the volume of the space between the upper end of the piston 226 and the top sub may be varied. The walls of the feed tube are uncontoured and are formed with two sets of apertures. One set 224 comprises a single aperture which extends for a considerable portion of the circumference of the feed tube but which has a relatively small dimension in the longitudinal axis of the feed tube. Alternatively the one set may comprise a series of circumferentially spaced apertures in the walls of the feed tube which have a relatively small axial dimension. The other set of apertures comprise a pair of longitudinally spaced apertures 225a and 225b located towards the free end of the feed tube from the one set of apertures 224. One aperture 225a of the other set of apertures which is located closest to said one set of apertures 224 is greater in size than the other of said apertures 225b and has a greater axial dimension than the other aperture 225b.

Towards the free end of the feed tube 220 the walls thereof are formed with a further aperture or set of apertures 236 having relatively large dimensions. A choke 223 is located in the feed tube between the two sets of apertures 224 and 225 and the further set of apertures 236 to provide a controlled continuous flow of fluid down through the drill bit 213.

The hammer further supports within the casing 211 a piston 226 which is longitudinally slidable within said casing 211 and over said feed tube 220. One end of said piston is provided with a port 227 while another port 229 is located at an intermediate position on the piston said ports communicate with a passage way 228 or 230 respectively extending from the respective port to the internal bore of said piston. The passage ways 228 and 230 are formed by obliquely boring a passage-way from the position of the respective port on the exterior of said piston to the bore of said piston. In addition the end of the piston adjacent the top sub 212 is counterbored to provide an expanded portion 231 in the bore of the piston which extends for a small portion of the length of the bore.

The circumferential face of the piston 226 between the intermediate position of the other port 229 and the other end of the piston 226 which is adjacent the drill bit is machined to provide a reduced diameter portion wherein the other end portion of that reduced diameter portion 232 is formed with a rib 233. In addition, the drill bit end of the casing supports a sleeve 234 which extends a small distance beyond the innermost position of the anvil 216 of the drill bit 213. The innermost end of the sleeve 234 is formed with a rib 235 dimensioned such that in the rib 233 at the other end of the piston 226 sealingly engages with the rib 235 on the sleeve when adjacent each other.

As shown at FIG. 7 to place the hammer in the "blow-down" position the hammer is moved axially away from the base of the drill hole in order that the drill bit 213 moves to its outermost position in the chuck and the bit ring 214 is engaged with the anvil 216 of the drill bit. When in the "blow-down" mode the piston 226 is retained in contact with the anvil 215. The maintenance of this position is a result of the counter-bored portion 231 at the one end of the hammer 226 being in communication with the one set of apertures 224 to provide fluid communication between the source of fluid pressure and the space located between the one end of the piston 226 and the top sub 212. Since no equivalent pressure or greater pressure is applied to the other end 29 of the piston through the passage ways 230 the piston 226 is positively retained in contact with the anvil. Fluid from the top sub end of the piston escapes to the drill bit via port 227 and the one passage-way 229 and the further aperture 236 located towards the free end of the feed tube. The further aperture 236 is dimensioned such that it permits as much flow as is possible into the drill bit to maximise the use of the fluid when in the "blow-down" position to clear cuttings from the bore hole.

Due to the small axial dimension of the one set of apertures if the piston should for some reason be moved from engagement with the anvil a fair degree of movement of the piston is required for the one set of apertures to communicate with the drill bit end of the piston through the passage way 230 and port 229. The small axial dimension of the one set of apertures ensures that there can be no overlap between the counter-bored portion and the passage-way 228 by the one set of apertures. Therefore, the possibility of back hammer is considerably reduced. In addition, due to the lack of restriction between the one set of apertures and the drill bit other than the counter-bored portion 231 and the passage way 228 connecting the drill bit end of the piston with the bore of the piston, the flow of air to the drill bit during "blow-down" is relatively unrestricted ensuring clearing of drill cuttings.

When the fluid operated hammer is moved axially towards the base of the drill hole such that the drill bit engages with the base of the bore hole the drill bit 213 moves into the fluid hammer. As a result (as shown in FIG. 8) the counter-bored portion 231 in the one end of the hammer 26 is isolated from the source of fluid pressure and the one passage way 228 connecting the top sub end port 227 of the piston 226 with the bore of the piston is isolated from the source of fluid pressure while the other passage way 230 connecting the drill bit port 229 of the piston 226 with the internal bore of the piston is in communication with the one set of apertures 224 in the feed tube 220, as a result fluid pressure from the fluid source is applied to the space between the reduced diameter portion 232 of the piston 226, the inner end of the sleeve 234 and the casing 211 due to the sealing interengagement between the ribs 233 and 235 on the piston 236 and sleeve 234 respectively. The resultant pressure differential produces an upward movement of the piston 26 from the drill bit.

The use of an aperture 224 of relatively small axial dimensions is a departure from previous practice and allows a greater control over the introduction of fluid at a precise point in the travel of the piston 226 and similarly causes the fluid flow to the piston to be shut off rapidly rather than having a gradual decrease as would occur if a longitudinally larger port were used.

If desired the one set of apertures 224 can be positioned to communicate fully with the drill bit end of the piston when the piston is raised a small distance from the anvil in order to make use of the reactive rebound of the piston after striking the anvil 16 in returning the piston to its position adjacent the centralising ring 221.

The use of the sleeve 234 in the drill bit end of the casing 211 reduces the volume of the space into which the other port 229 delivers fluid to effect the movement of the piston towards the drill bit. This reduces the volume of fluid required to return the piston to its position adjacent the drill bit.

When the piston 226 is in its position adjacent the centralising ring 221 (as shown at FIG. 3) the other passage way 230 between the other port 229 of the piston 226 and the bore of the piston is not in communication with any source of fluid pressure while the one passage way 228 providing communication between the one port 227 of the piston 226 and the bore is in communication with the one aperture **225*a* of the other set of apertures 225. The resultant increased pressure in the space between the top sub 12 and the corresponding end of the piston produces a thrust on the piston 26** to cause it to move towards the drill bit.

The pressure producing the thrust on the piston 226 is reduced once the opening of the one passage way 228 into the bore of the piston 226 passes the edge of the one aperture **225*a* but is further reinforced when the opening of the one passage way 228 communicates with the other aperture 225*b* of the other set of apertures 25 during the movement of the piston 26** toward the drill bit.

The location of the spaced apertures **225*a* and 225*b* allows greater control over the distance that the piston 226 moves over previous methods which utilise one aperture only. The greater control stems from the fact that by variation of the spacing between the apertures 225*a* and 225*b* the frequency and force of impact of the piston 26 on the drill bit can be varied according to the geological conditions in which the hammer is being used or the pressure of the fluid being used. To effect such variation requires the replacement of the feed tube 220 only, whereas previous hammers have required the replacement of completely different assemblies to effect the same variation. In addition, by varying the spacer ring 221** simultaneously or independently with the feed tube the performance characteristics can be optimised to suit the conditions or specifications of the holes being drilled.

In existing hammers when the apertures required to effect the thrust on the piston to drive it onto the drill bit are raised in position on the feed tube in order to lengthen the strike of the piston there is little increase in the impact force of the piston on the drill bit. By introducing a second aperture **225*b* additional pressure is introduced into the space above the piston to provide an additional thrust on the piston during its movement towards the drill bit. It will be appreciated that the use of the two apertures 225*a* and 225*b* also serves to introduce further fluid into the space above the piston during the movement of the piston from the drill bit. However since such fluid is introduced into a space previously evacuated of pressurised fluid in a precise and limited manner due to the reduced size of the second apertures 225*b*** and since at the time of such introduction the piston has almost attained its maximum velocity such introduction does not greatly effect the pistons movement from the drill bit.

In addition the fluid input into the space between the top sub 212 and the piston 226 and during the upward movement of the piston 226 to serve to prevent the impact of the piston 226 with the top sub 212.

As a result of the third embodiment a fluid operated hammer is produced having the same advantages as the second embodiment described above.

It should be noted that the hammer of each embodiment may be used for bore holes disposed at any angle from a work station above and below the horizontal axis.

It should be appreciated that the scope of the invention need not be restricted to the particular scope of the embodiments described above.

I claim:

1. In a fluid operated hammer drill comprising a casing defining a bore, means including a drill bit supporting member for closing one end of said bore, a hammer piston having oppositely facing first and second ends reciprocally supported in said bore for movement from a retracted position wherein said second piston end is spaced from said one end and an impact position at said one end wherein said first piston end impacts said drill bit supporting member, and a fluid pressure inlet, the improvement comprising porting means in fluid communication with said fluid pressure inlet and opened and closed responsive to the relative position of said hammer piston for pressurizing said first end of said hammer piston when said hammer position is contiguous to said one end for driving said hammer piston away from said one end toward its retracted position, for pressurizing the second end of said piston when said piston is at first distance from said one end and contiguous to said retracted position, and for pressurizing said second end of said hammer piston again when said hammer piston is closely adjacent said one end, but spaced from its impact position toward said retracted position and from the point of said first mentioned pressurization of said second end.

2. In a fluid operated hammer drill as set forth in claim 1 wherein the porting means comprises a plurality of spaced ports.

3. In a fluid operated hammer drill as set forth in claim 2 wherein the hammer piston operates as a valving member for sequentially opening and closing the ports.

4. In a fluid operated hammer drill as set forth in claim 3 wherein the hammer piston has passages extending through the hammer piston and adapted to communicate with the ports for delivering fluid to the opposite ends of said hammer piston.

5. In a fluid operated hammer drill as set forth in claim 4 wherein the hammer passages open through the opposite ends of the hammer piston and communicate at inlets that are adapted to sequentially register with the ports, said passage inlets being spaced from each other.

6. In a fluid operated hammer drill as set forth in claim 5 further including a feed tube extending from the fluid pressure inlet and passing through a bore in said hammer piston, the ports being formed in said feed tube.

7. In a fluid operated hammer drill as set forth in claim 6 wherein the ports are axially spaced along the feed tube, the inlet to the passage serving the one end of the hammer piston being adapted to communicate with a lesser number of said ports than the inlet to the passage communicating with the other end of the hammer piston.

8. In a fluid operated hammer drill as set forth in claim 6 wherein the feed tube is detachably supported within the casing and is held in place by a locking member and a spacer, said spacer being removable for varying the axial position of the feed tube and the volume of the bore.

9. In a fluid operated hammer drill as set forth in claim 7 wherein the feed tube is detachably supported within the casing and is held in place by a locking member and a spacer, said spacer being removable for varying the axial position of the feed tube and the volume of the bore.

10. In a fluid operated hammer drill as set forth in claim 4 wherein the bore is substantially continuous throughout its length.

11. In a fluid operated hammer drill as set forth in claim 4 wherein the one end of the bore is provided with a reduced diameter section and the one end of the hammer piston has a reduced diameter section adapted to extend into said bore reduced diameter section.

12. In a fluid operated hammer drill as set forth in claim 11 wherein the drill bit supporting member has a portion extending into the bore reduced diameter portion.

13. In a fluid operated hammer drill as set forth in claim 12 wherein the drill bit supporting member is slidably supported within the bore reduced diameter section.

14. In a fluid operated hammer drill as set forth in claim 1 wherein the porting means is effective to briefly pressurize the opposite head of the hammer piston before the hammer piston has moved fully to its retracted position.

15. In a fluid operated hammer drill as set forth in claim 14 wherein the porting means comprises a plurality of spaced ports.

16. In a fluid operated hammer drill as set forth in claim 15 wherein the hammer piston operates as a valving member for sequentially opening and closing the ports.

17. In a fluid operated hammer drill as set forth in claim 16 wherein the hammer piston has passages extending through the hammer piston and adapted to communicate with the ports for delivering fluid to the opposite ends of said hammer piston.

18. In a fluid operated hammer drill as set forth in claim 17 wherein the hammer piston passages open through the opposite ends of the hammer piston and communicate at inlets that are adapted to sequentially register with the ports, said passage inlets being spaced from each other.

19. In a fluid operated hammer drill as set forth in claim 18 further including a feed tube extending from the fluid pressure inlet and passing through a bore in said hammer piston, the ports being formed in said feed tube.

20. In a fluid operated hammer drill as set forth in claim 19 wherein the ports are axially spaced along the feed tube, the inlet to the passage serving the one end of the hammer piston being adapted to communicate with a lesser number of said ports than the inlet to the passage communicating with the other end of the hammer piston.

* * * * *

UNITED STATES PATENT AND TRADEMARK OFFICE

CERTIFICATE OF CORRECTION

PATENT NO. : 4,534,422

DATED : August 13, 1985

INVENTOR(S) : Ian G. Rear

It is certified that error appears in the above-identified patent and that said Letters Patent is hereby corrected as shown below:

ON THE TITLE PAGE, insert the heading "Foreign Application Priority Data", and insert "July 1, 1980 - Australia - PE4314"

Column 1, line 33, "withihn" should be --within--.

Column 1, line 38, after "it is" insert --common--.

Column 1, line 64, "centalising" should be --centralising--.

Column 4, line 10, "bot" should be --bit--.

Column 7, line 44, "it" should be --It--.

Column 12, line 9, "2" should be --20--.

Column 12, line 33, "structure" should be --aperture--.

Column 19, line 24, Claim 1, after "at" insert --a--.

Signed and Sealed this

Thirtieth Day of December, 1986

*Attest:*

DONALD J. QUIGG

*Attesting Officer*

*Commissioner of Patents and Trademarks*